US008002389B2

(12) United States Patent
Hara

(10) Patent No.: US 8,002,389 B2
(45) Date of Patent: Aug. 23, 2011

(54) LIQUID JETTING APPARATUS

(75) Inventor: Koichiro Hara, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 366 days.

(21) Appl. No.: 12/156,981

(22) Filed: Jun. 6, 2008

(65) Prior Publication Data

US 2008/0303877 A1 Dec. 11, 2008

(30) Foreign Application Priority Data

Jun. 8, 2007 (JP) ..... 2007-152554

(51) Int. Cl.

| | |
|---|---|
| ***B41J 2/045*** | (2006.01) |
| ***B41J 2/015*** | (2006.01) |
| ***B41J 2/135*** | (2006.01) |
| ***B41J 2/16*** | (2006.01) |
| ***B41J 2/05*** | (2006.01) |

(52) U.S. Cl. ..... 347/71; 347/20; 347/44; 347/47; 347/65; 347/68; 347/69; 347/70; 347/72

(58) Field of Classification Search ..... 347/20, 347/44, 47, 54, 65, 68–72
See application file for complete search history.

(56) References Cited

U.S. PATENT DOCUMENTS

| | | | | |
|---|---|---|---|---|
| 6,467,886 | B1 | 10/2002 | Takao et al. | |
| 2003/0156166 | A1 * | 8/2003 | Sakaida | 347/68 |
| 2005/0157097 | A1 * | 7/2005 | Terakura | 347/72 |
| 2006/0181581 | A1 * | 8/2006 | Jung et al. | 347/68 |
| 2007/0052764 | A1 * | 3/2007 | Oku | 347/68 |
| 2007/0126803 | A1 * | 6/2007 | Iriguchi | 347/68 |
| 2008/0100676 | A1 * | 5/2008 | Sakaida | 347/70 |

FOREIGN PATENT DOCUMENTS

| | | |
|---|---|---|
| JP | 2006341509 | 12/2006 |
| WO | WO 01/19614 | 3/2001 |

* cited by examiner

*Primary Examiner* — Charlie Peng
*Assistant Examiner* — Hung Lam
(74) *Attorney, Agent, or Firm* — Frommer Lawrence & Haug LLP

(57) ABSTRACT

A liquid jetting apparatus includes: a cavity unit having a plurality of nozzles and pressure chambers; and an actuator unit applying jetting pressures to the pressure chambers. The actuator unit has a plurality of stacked ceramics layers, individual electrodes corresponding to the pressure chambers, a common electrode common to all the pressure chambers, and a barrier layer preventing the liquid from being penetrated therethrough. The barrier layer is stacked on a position which is between a contact surface, of the actuator unit, making contact with the cavity unit and the individual electrodes closest to the contact surface, except a position on the contact surface. It is possible to prevent the individual electrodes and the common electrode from being electrically short-circuited due to the liquid even when the ceramics layer in contact with the cavity unit has a crack.

12 Claims, 2 Drawing Sheets

LIQUID JETTING APPARATUS

CROSS REFERENCE TO RELATED APPLICATION

The present application claims priority from Japanese Patent Application No. 2007-152554, filed on Jun. 8, 2007, the disclosure of which is incorporated herein by reference in its entirety.

BACKGROUND OF THE INVENTION

1. Field of the Invention

The present invention relates to a liquid jetting apparatus including a cavity unit having a plurality of nozzles through each of which a liquid is jetted and pressure chambers communicating with the nozzles respectively, and an actuator unit applying jetting pressures to the pressure chambers.

2. Description of the Related Art

As a conventional liquid jetting apparatus, there is, for example, an ink-jet head which includes: a plate-shaped cavity unit having one surface in which a plurality of nozzles for jetting minute ink droplets are formed and other surface on which a plurality of pressure chambers communicating with the nozzles respectively are opened; and a plate-shaped actuator unit which is stacked on the cavity unit to apply jetting pressures to the pressure chambers of the cavity unit.

The actuator unit has a plurality of stacked ceramics layers, and individual electrodes which are individually disposed so as to correspond to the pressure chambers of the cavity unit respectively and a common electrode common to all the pressure chambers (ground electrode) are disposed between the ceramics layers. A predetermined number of sets of the individual electrodes and the common electrode are arranged alternately. In each of the ceramics layers, portions sandwiched by the individual electrodes and the common electrode are active portions. The actuator unit is joined to the aforesaid other surface of the cavity unit so that the active portions face the pressure chambers respectively. When voltage is applied between the individual electrode and the common electrode of the actuator unit to drive the active portion, the actuator unit deforms to change the volume of the pressure chamber of the cavity unit. Consequently, a jetting pressure is applied to the liquid (ink) in the pressure chamber, so that the ink is jetted from the nozzle corresponding to this pressure chamber.

Since the actuator unit has a ceramics sintered compact, the actuator unit easily suffers a minute crack due to the deformation when fired or driven. When such a defect exists, there is a risk of the ink in the pressure chambers entering a crack at a place where the ceramics layer of the actuator unit is in direct contact with a cavity plate. In such a case, the ink entering the crack penetrates into the ceramics layer, which in turn is likely to cause electric short-circuit between the individual electrodes and the common electrode.

To avoid this problem, in an ink-jet head described in Japanese Patent Application Laid-open No. 2006-341509 (pages 5 to 7, FIG. 3), a conductive protection film is formed on a joint surface, of an actuator unit, joined to a cavity unit, thereby preventing a ceramics layer from coming into direct contact with ink in pressure chambers. This protection film is made of conductive paste which is fired after applied on the actuator unit. The protection film further prevents the ink in the pressure chambers from being charged.

SUMMARY OF THE INVENTION

The protection film which is formed to be exposed to an outer surface of the actuator unit as described above is likely to be flawed in manufacturing processes following the firing of the actuator unit, and when the ceramics layer has a crack, the ink enters the crack of the ceramics layer through the flaw of the protection film, which in turn may cause electric short circuit between the individual electrodes and the common electrode.

It is an object of the present invention to provide a liquid jetting apparatus in which electric short circuit between individual electrodes and a common electrode ascribable to liquid can be avoided even when a ceramics layer, of an actuator unit, in contact with a cavity unit has a crack.

According to a first aspect of the present invention, there is provided a liquid jetting apparatus which jets a liquid, the apparatus including:

a cavity unit having a plurality of nozzles through which the liquid is jetted, and a plurality of pressure chambers which communicate with the nozzles and in which predetermined openings are formed, respectively; and an actuator unit which is stacked on the cavity unit in a predetermined stacking direction, with a predetermined contact surface of the actuator covering the openings of the cavity unit; and in which a plurality of ceramics layers stacked in the stacking direction, a plurality of individual electrodes individually arranged corresponding to the pressure chambers respectively, a common electrode provided in common to all the pressure chambers, and a barrier layer preventing the liquid from penetrating therethrough are stacked, wherein the individual electrodes and the common electrode are arranged to sandwich one of the ceramics layers, and the actuator unit applies a jetting pressure selectively to the pressure chambers by applying a predetermined driving voltage to a portion, of the one of the ceramics layers, sandwiched between one of the individual electrodes and the common electrode; and the barrier layer is stacked at a position of the actuator unit between the contact surface and a certain individual electrode which is closest to the contact surface among the individual electrodes, the position being different from a position on the contact surface.

According to the first aspect of the present invention, since the barrier layer is provided on the position between the contact surface and the individual electrodes closest to the contact surface, except the position on the contact surface, the barrier layer is not exposed to an outer surface of the actuator unit. Therefore, in manufacturing processes following the firing of the actuator unit, it is possible to prevent the barrier layer from being flawed. Further, when the ceramics layer making contact with the cavity unit has a crack, there is a risk of the liquid in the pressure chambers entering from the crack and penetrating into the ceramics layer. Nevertheless, owing to the presence of the barrier layer, the ink which has penetrated into the ceramics layer is blocked from reaching the individual electrodes. Therefore, it is possible to avoid short circuit between the individual electrodes and the common electrode ascribable to the liquid.

Therefore, even when the ceramics layer, of the actuator unit, making contact with the cavity unit has a crack, there occurs no electric short circuit and thus no problem such as a jetting failure is not caused, which consequently can enhance reliability of the apparatus.

It is only necessary for the barrier layer to be between the contact surface and the individual electrodes closest to the contact surface, and the barrier layer can be disposed between the ceramics layer and the individual electrodes or between the ceramics layer and the common electrode. Another alternative is to divide the ceramics layer in the stacking direction and insert the barrier layer between divided portions.

In the liquid jetting apparatus of the present invention, the common electrode may be arranged between one ceramics layer, among the ceramics layers, making contact with the cavity unit and another ceramics layer, among the ceramics layers, stacked on a surface of the one ceramics layer, the surface not facing the cavity unit; and the barrier layer may be provided between the common electrode and the one ceramics layer.

In this case, since the barrier layer can be provided between the ceramics layer in contact with the cavity unit and the common electrode, the barrier layer can be stacked so as not to be exposed to the outer surface of the actuator unit. Therefore, in manufacturing processes following the fixing of the actuator unit, it is possible to prevent the barrier layer from being flawed. Further, when the ceramics layer making contact with the cavity unit has a crack, there is a risk of the liquid in the pressure chambers entering from the crack and penetrating into the ceramics layer to reach the barrier layer. Even in such a case, since the barrier layer is difficult to be flawed, the liquid is blocked from penetrating into the common electrode, and as a result, short circuit between the individual electrodes and the common electrode due to the liquid can be avoided.

As described above, even when the ceramics layer, of the actuator unit, in contact with the cavity unit has a crack, the liquid does not penetrate beyond the common electrode owing to the barrier layer. Therefore, there occurs no electric short circuit between the individual electrodes and the common electrode and thus no problem such as a jetting failure occurs, which can consequently enhance reliability of the apparatus.

In the liquid jetting apparatus of the present invention, the barrier layer may be sintered together with the ceramics layers. In this case, the formation of the barrier layer can proceed simultaneously with the sintering of the actuator unit. Therefore, reliability of the apparatus is enhanced and manufacturing processes are simplified.

In the liquid jetting apparatus of the present invention, each of the ceramics layers may be formed of a ceramics material in a sheet form, and the barrier layer may be formed of oxide ceramics. In this case, when materials of which thermal expansion coefficients are close to each other are used for the ceramics layers and the barrier layer, it is possible to reduce the deformation such as warp when the actuator unit is sintered. Since the deformation such as warp when the actuator unit is sintered can be thus reduced, structural reliability can be enhanced as well.

In the liquid jetting apparatus of the present invention, the oxide ceramics may be selected from a group consisting of silicon dioxide, alumina, and titanium dioxide. In this case, the deformation such as warp when the actuator unit is sintered can be effectively reduced. Since the deformation such as warp when the actuator unit is sintered can be thus reduced, structural reliability can be enhanced as well.

In the liquid jetting apparatus of the present invention, the barrier layer may be formed of a ceramics material different from a material forming the ceramics layer. In this case, a material not easily suffering a crack or the like can be selected as the barrier layer. Further, materials of which thermal expansion coefficients are close to each other can be used for the ceramics layers and the barrier layer in order to effectively reduce the deformation such as warp when the actuator unit is sintered. Thus, the material can be selected from a wider range. Further, by the use of the ceramics material for forming the barrier layer, it is possible to form the barrier layer resistant against high temperature. Therefore, there is no risk of the barrier layer being affected when the ceramics layers are fired at high temperature.

In the liquid jetting apparatus of the present invention, the barrier layer may have a thickness smaller than that of each of the ceramics layers. In this case, since the barrier layer is formed thinner than the ceramics layers, rigidity of the barrier layer can be lowered. Therefore, there is no risk of the barrier layer hindering the deformation of the ceramics layers. The thickness of the barrier layer may be less than 10 μm and the thickness of each of the ceramics layers may not be less than 10 μm. Further, the thickness of the barrier layer may not be more than 1 μm. In any of the cases, since the rigidity of the barrier layer can be lowered, there is not risk of the barrier layer hindering the deformation of the ceramics layers. Nevertheless, in any of the cases, since the barrier layer is thick enough to block the penetration of the liquid, it is possible to prevent the liquid from penetrating beyond the barrier layer.

In the liquid jetting apparatus of the present invention, the barrier layer may be an insulative layer. In this case, since both sides of the barrier layer can be surely insulated from each other, there is no risk of the individual electrodes coming into electric conduction with the liquid.

DETAILED DESCRIPTION OF THE PREFERRED EMBODIMENTS

Figure 1:
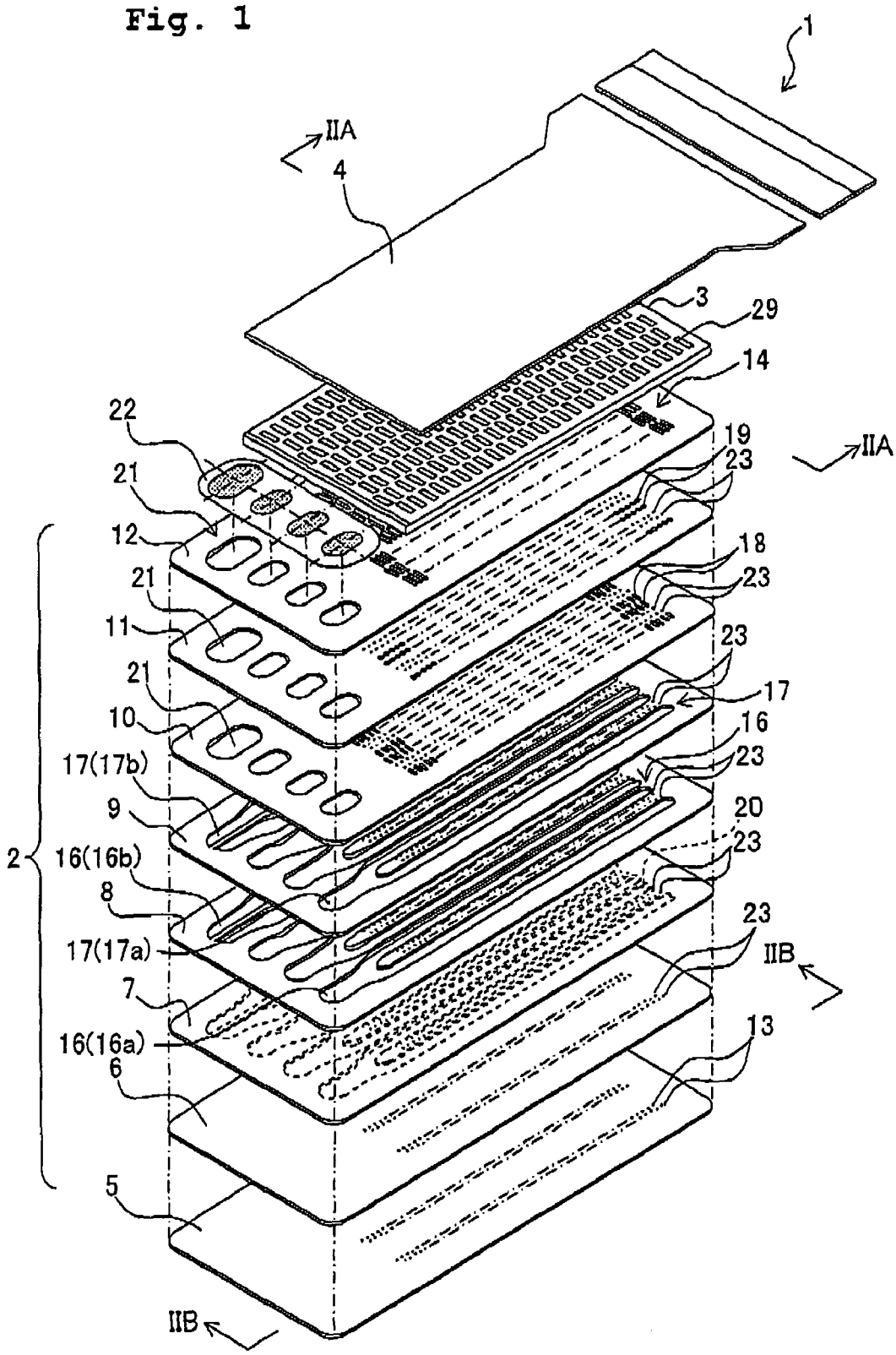
FIG. 1 is an exploded perspective view of an embodiment of a liquid jetting apparatus according to the present invention.
Figure 2B:
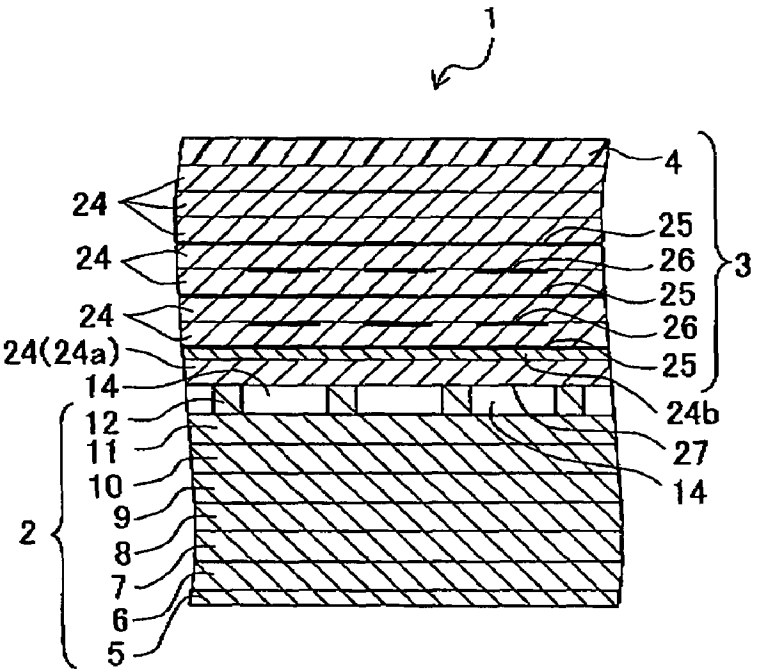
FIG. 2B is a partial enlarged sectional view seen in the direction of the arrows IIB-IIB in FIG. 1.
Figure 2A:
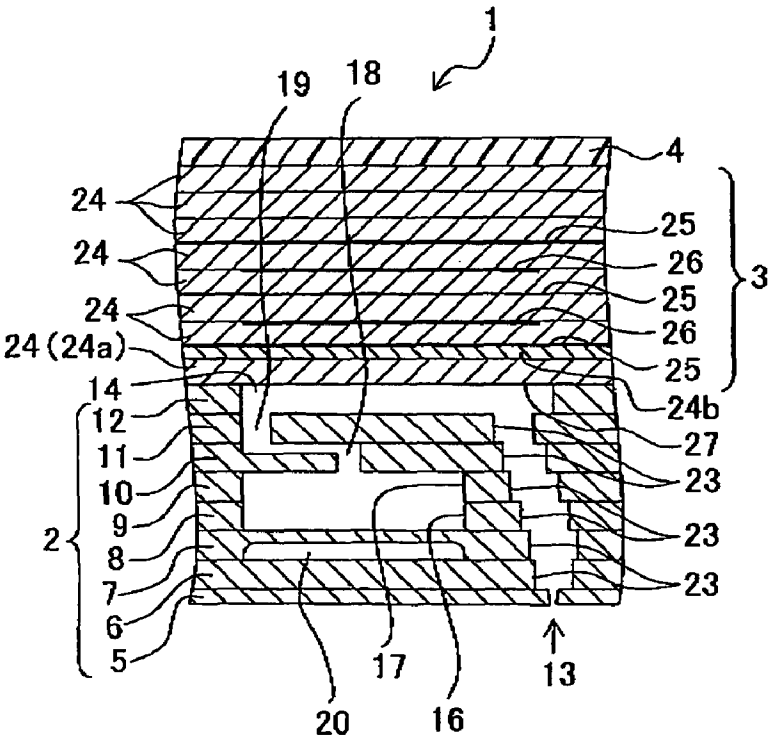
FIG. 2A is a partial enlarged sectional view seen in the direction of the arrows IIA-IIA in FIG. 1.

An embodiment of a liquid jetting apparatus according to the present invention will be explained with reference to FIGS. 1, 2A, and 2B. FIG. 1A is an exploded perspective view of a liquid jetting apparatus 1, FIG. 2A is a partial enlarged sectional view seen in the direction of the arrows IIA-IIA in FIG. 1, and FIG. 2B is a partial enlarged sectional view seen in the direction of the arrows IIB-IIB in FIG. 1.

The liquid jetting apparatus 1 includes a plate-shaped cavity unit 2, a plate-shaped actuator unit 3 stacked on the cavity unit 2, and a flexible flat cable 4 joined to a surface, of the actuator unit 3, opposite the cavity unit 2 and connected to an external apparatus.

The cavity unit 2 has a stacked structure in which a plurality of plates are stacked. Concretely, a nozzle plate 5, a spacer plate 6, a damper plate 7, two manifold plates 8, 9, a supply plate 10, a base plate 11, and a cavity plate 12 are stacked in this order from a side facing a recording medium.

The nozzle plate 5 is made of synthetic resin such as polyimide. The nozzle plate 5 has a plurality of nozzle rows 13*a* corresponding to ink colors respectively, and each of the nozzle rows 13*a* includes a plurality of nozzles 13 jetting ink. In the adjacent nozzle rows 13*a*, positions of the nozzles 13 are deviated from each other. That is, the nozzles 13 are arranged in a zigzag pattern.

The cavity plate 12 has rows (pressure chamber rows) corresponding to the colors of the supplied inks respectively, and each of the pressure chamber rows includes pressure chambers 14 corresponding to the nozzles 13. Here, jetting pressures are applied to the liquid in the pressure chambers 14 as will be described later.

In the two manifold plates 8, 9, through holes 16, 17 extending in a direction in which the nozzle rows 13*a* extend (extension direction) are formed respectively. As a result of stacking the manifold plates 8, 9 on each other, the through holes 16, 17 communicate with each other, and consequently a plurality of common ink chambers 160 are formed. Here, the common ink chambers 160 correspond to the ink colors respectively. Specifically, the common ink chambers 160 include common ink chambers 160*a* formed by through holes 16*a*, 17*a* corresponding to color inks and common ink chambers 160*b* formed by through holes 16*b*, 17*b* corresponding to a black ink. In a plane view, the common ink chambers 160 are provided on both sides of each of the nozzle rows 13*a* jetting the corresponding ink. The common ink chambers 160*a* provided on both sides of the nozzle row 13*a* corresponding to the color ink join each other at their longitudinal one end, and the common ink chambers 160*b* on both sides corresponding to the black ink come close to each other at their longitudinal one end.

In the supply plate 10, ink supply channels 18 distributing the inks in the common ink chambers 160 to the pressure chambers 14 of the cavity plate 12 are formed. The ink supply channels 18 are arranged in rows correspond to the colors of the supplied inks respectively.

In the base plate 11, communication holes 19 communicating with the ink supply channels 18 of the supply plate 10 and with the pressure chambers 14 of the cavity plate 12 respectively are provided. Here, each of the communication holes 19 is formed so as to communicate with one-side end of one of the pressure chambers 14.

Damper chambers 20 absorbing pressure fluctuation is formed in a surface, of the damper plate 7, opposite the manifold plate 8, the damper chambers 20 being formed by half etching at positions overlapping with the common ink chambers 160 in a plane view.

Ink supply ports 21 corresponding to the respective color inks penetrate through plates from the cavity plate 12 to the supply plate 10 at positions overlapping with extensions of the rows of the pressure chambers 14 to communicate with the common ink chambers 160 (through holes 16, 17) of the manifold plates 8, 9. On each of the ink supply ports 21, a filter 22 capturing dusts and the like contained in the ink is disposed. Further, ink channels 23 via which the pressure chambers 14 of the cavity plate 12 and the nozzles 13 of the nozzle plate 5 communicate with each other are formed as through holes to penetrate through plates from the base plate 11 to the spacer plate 6.

When the ink is supplied from the ink supply port 21 of the cavity unit 2, the ink enters the common ink chambers 160 of the manifold plates 8, 9 and thereafter is supplied to the pressure chambers 14 of the cavity plate 12 through the ink supply channel 18 of the supply plate 10 and the communication hole 19 of the base plate 11. The ink supplied to the pressure chambers 14 is jetted from the nozzles 13 through the ink channel 23.

The actuator unit 3 has a stacked structure which is formed in such a manner that a plurality of sheets (piezoelectric layers, first ceramics layers) 24 made of a ceramics material are stacked in the same direction as the direction in which the actuator unit 3 and the cavity unit 2 are stacked and then these sheets are fired (sintered, calcinated). The actuator unit 3 is joined on the cavity plate 12 by an adhesive or the like. Each of the first ceramics layers 24 of the actuator unit 3 has an area large enough to cover all the pressure chambers 14. A lowest ceramics layer 24*a* of the actuator unit 3 covers openings of the through holes of the cavity plate 12 which serve as the pressure chambers 14. That is, the lowest ceramics layer 24*a* form upper surfaces of the pressure chambers 14. Note that in the actuator unit 3, the cavity unit 2 side is defined as a lower side and the flexible flat cable 4 side is defined as an upper side.

The first ceramics layers 24 are made of a ferroelectric, piezoelectric material whose main component is lead zirconate titanate (PZT) which is a polymer of lead titanate and lead zirconate. The first ceramics layers 24 are polarized in their thickness direction in advance.

Among the first ceramics layers 24, a barrier layer (second ceramics layer) 24*b* not allowing the ink to penetrate therethrough is interposed between, the lowest ceramics layer 24*a* and the other ceramics layers 24 stacked thereon. The barrier layer 24*b* is a ceramics layer made of silicon dioxide and has a thickness of about 1 μm. As will be described later, the barrier layer 24*b* plays a role of preventing the liquid such as the ink from reaching the individual electrodes 26. The common electrode 25 covering all the pressure chambers 14 of the cavity unit 2 is disposed between the barrier layer 24*b* and the first ceramics layer 24 upwardly adjacent to the barrier layer 24*b*. Further, the individual electrodes 26 which are discretely provided to face the pressure chambers 14 respectively on the surface, not facing the common electrode 25, of the ceramics layer 24 adjacent to the barrier layer 24*b*. In this manner, the individual electrodes 26 and the common electrode 25 are arranged alternately in gaps between the first ceramics layers 24. As described above, the first ceramics layers 24 sandwiched by the individual electrodes 26 and the common electrode 25 are made of, for example, a ferroelectric lead zirconate titanate (PZT)-based ceramics material, and are polarized in the direction in which the individual electrodes 26 and the common electrode 25 face each other (the direction in which the first ceramics layers 24 are stacked). Therefore, each portion (active portion, deformable portion), of the first ceramics layers 24, sandwiched by the individual electrode 26 and the common electrode 25 deforms in the stacking direction when voltage is applied between the individual electrode 26 and the common electrode 25.

On top of the first ceramics layers 24 each sandwiched by the individual electrodes 26 and the common electrode 25, the actuator unit 3 has a plurality of first ceramics layers 24 none of which is sandwiched by the individual electrodes 26 and the common electrode 25. These first ceramics layers 24 (restraint layers) none of which is sandwiched by the individual electrodes 26 and the common electrode 25 do not contribute to the deformation. However, the aforesaid restraint layers restrain the deformation of the active portions so that the active portions deform toward the pressure chamber 14. On an uppermost surface of the actuator unit 3, surface electrodes 29 corresponding to the individual electrodes 26 and the common electrodes 25 are provided. The surface electrodes 29 are electrically connected to the corresponding individual electrodes 26 and common electrodes 25 via through holes (not shown). Further, the surface electrodes 29 are joined to a circuit of the flexible flat cable 4.

The actuator unit 3 is manufactured in the following manner. The barrier layer 24*b* is formed on an upper surface of the lowest first ceramics layer 24*a*, and the common electrode 25 is further formed on an upper surface of the barrier layer 24*b*. Here, the common electrode 25 is formed by printing. The first ceramics layer 24 on which the individual electrodes 26 are printed is stacked above the upper surface of the lowest ceramics layer 24*a*. Further, another first ceramics layer 24 on which the common electrode 25 is printed is stacked on the first ceramics layer 24. In this manner, the first ceramics layers 24 each having the printed common electrode and the first ceramics layers 24 each having the printed individual electrodes 25 are alternately stacked. Further, the first ceramics layers 24 having no common electrode 25 and no individual electrode 26 are stacked, and the ceramics layer 24 on which the surface electrodes 29 are printed is stacked. Thereafter, a stack of these layers is fired (sintered) and integrated.

In this embodiment, the barrier layer 24*b* is made of silicon dioxide. Silicon dioxide is a ceramics-based material and has a thermal expansion coefficient close to that of the first ceramics layers 24, and therefore, the barrier layer 24*b* can be fired and formed integrally with the actuator unit 3. Further, the deformation such as warp does not easily occur in such a barrier layer 24*b* at the time of the firing. Incidentally, not only the use of silicon dioxide but also, for example, the use of alumina, titanium dioxide, or the like can effectively reduce the deformation after the firing. As described above, the barrier layer 24*b* is made of an oxide ceramics material, while the first ceramics layers 24 are made of a piezoelectric ceramics material such as PZT. Further, the barrier layer 24*b* has a thickness of about 1 μm to several μm (may be 1 μm or less, but is not 10 μm or more), while the first ceramics layers 24 has a thickness of about 30 μm (several tens μm, that is, 10 μm or more), and these layers are greatly different in this respect as well. Incidentally, the barrier layer 24*b* does not necessarily have to be made of such an oxide ceramics material, but the use of an insulative material such as the oxide ceramics material for forming the barrier layer 24*b* as described above makes it possible to surely insulate the both sides of the barrier layers 24*b* from each other. It should be noted that the material of the barrier layer 24*b* is not limited to the oxide ceramics material. Any material not allowing the ink to penetrate therethrough and not melting away when the actuator unit 3 is fired is usable for the barrier layer 24*b*.

Further, the barrier layer 24*b* is stacked between the ceramics layers 24. Since the barrier layer 24*b* is not exposed to the outer surface, the barrier layer 24*b* can prevent the barrier layer 24*b* from being flawed or cracked in the process of, for example, joining the actuator unit 3 to the cavity unit 2. When voltage is applied between the individual electrode 26 and the common electrode 25 of the actuator unit 3 joined to the cavity unit 2, the portion (active portions), of the ceramics layer 24, sandwiched by the individual electrode 26 and the common electrode 25 expands and deforms to bulge toward the pressure chamber 14 as described above. Accordingly, the volume of the pressure chamber 14 is reduced and the pressure is applied to the ink in the pressure chamber 14. As a result, the ink is jetted through the nozzle 13 communicating with the pressure chamber 14.

In the liquid jetting apparatus 1, in case the ceramics layer 24*a* is cracked when the actuator unit 3 is fired or when the actuator unit 3 is driven, the ink in the pressure chambers 14 enters the crack. Even if the ink entering the crack penetrates into the ceramics layer 24*a*, the ink dose not penetrate beyond the barrier layer 24*b* to enter the inside of the actuator unit 3 owing to the presence of the barrier layer 24*b*. Therefore, it is possible to avoid a problem that the ink causes electrical short circuit between the individual electrodes 26 and the common electrode 25 of the actuator unit 3.

In the above-described embodiment, the barrier layer 24*b* is disposed between the common electrode 25 and the lowest ceramics layer 24*a*. However, the arrangement of the barrier layer 24*b* is not limited to this. For example, when the common electrode 25 and the cavity unit 2 are at the same potential because they are electrically grounded or the like, the barrier layer 24*b* may be disposed between the common electrode 25 and the individual electrodes 26. In this case, even if the ink reaches the common electrode 25, the common electrode 25 simply comes to have the same potential as the ink, and the operation of the liquid jetting apparatus 1 is not affected. Here, since the barrier layer 24*b* is formed between the common electrode 25 and the individual electrodes 26, there is no risk of the ink penetrating beyond the barrier layer 24*b* to reach the individual electrodes 26. That is, there is no risk of the common electrode 25 and the individual electrodes 26 being short-circuited due to the ink. In this case, the barrier layer 24*b* may be provided at least between a contact surface 27, of the actuator unit 3, making contact with the cavity unit 2 and the individual electrodes 26 closest to the contact surface 27.

Further, when the positions of the common electrode 25 and the individual electrodes 26 are exchanged in such a manner that the individual electrodes 26, the common electrode 25, and the individual electrodes 26 are arranged in this order from the lower side, the barrier layer 24*b* can be disposed between the lowest individual electrodes 26 and ceramics layer 24*a*. Another possible alternative is that the lowest ceramics layer 24*a* or the ceramics layer 24 upwardly adjacent thereto is divided in the stacking direction and the barrier layer 24*b* is inserted between divided portions. Further, the barrier layers 24*b* is not limited to a single layer, and may be provided in multiple layers.

Further, the barrier layer 24*b* does not necessarily have to be disposed to cover the whole surface of the ceramics layer 24*a*. The barrier layer 24*b* can be provided, for example, only in areas substantially corresponding to the pressure chambers 14 (areas covering the individual electrodes 26), between the ceramics layers 24, provided that the ink can be prevented from reaching the individual electrodes 26.

The above-described embodiment explains the example where the liquid jetting apparatus is embodied as an ink-jet head, but the present invention is applicable to an apparatus which applies liquid other than ink, such as an apparatus which applies, for example, coloring liquid to fabricate a color filter of a liquid crystal display.

What is claimed is:

1. A liquid jetting apparatus which jets a liquid, the apparatus comprising:

a cavity unit having a plurality of nozzles through which the liquid is jetted, and a plurality of pressure chambers which communicate with the nozzles and in which predetermined openings are formed, respectively; and an actuator unit which is stacked on the cavity unit in a predetermined stacking direction, with a predetermined contact surface of the actuator covering the openings of the cavity unit;

wherein the actuator comprises:

a plurality of ceramics layers stacked in the stacking direction;

a plurality of individual electrodes individually arranged corresponding to the pressure chambers respectively;

a common electrode provided in common to all the pressure chambers; and a barrier layer preventing the liquid from penetrating therethrough are stacked;

wherein the individual electrodes and the common electrode are arranged to sandwich one of the ceramics layers, and the actuator unit applies a jetting pressure selectively to the pressure chambers by applying a predetermined driving voltage to a portion, of the one of the ceramics layers, sandwiched between one of the individual electrodes and the common electrode; and wherein the barrier layer is stacked at a position of the actuator unit between the contact surface and a certain individual electrode which is closest to the contact surface among the individual electrodes, the position being different from a position on the contact surface such that the barrier layer does not directly contact the cavity unit.

2. The liquid jetting apparatus according to claim 1; wherein the common electrode is arranged between one ceramics layer, among the ceramics layers, making contact with the cavity unit and another ceramics layer, among the ceramics layers, stacked on a surface of the one ceramics layer, the surface not facing the cavity unit; and the barrier layer is provided between the common electrode and the one ceramics layer.

3. The liquid jetting apparatus according to claim 1; wherein the barrier layer is sintered together with the ceramics layers.

4. The liquid jetting apparatus according to claim 1; wherein each of the ceramics layers is formed of a ceramics material in a sheet form, and the barrier layer is formed of oxide ceramics.

5. The liquid jetting apparatus according to claim 4; wherein the oxide ceramics is selected from a group consisting of silicon dioxide, alumina, and titanium dioxide.

6. The liquid jetting apparatus according to claim 1; wherein the barrier layer is formed of a ceramics material different from a material forming the ceramics layers.

7. The liquid jetting apparatus according to claim 1; wherein the barrier layer has a thickness smaller than that of each of the ceramics layers.

8. The liquid jetting apparatus according to claim 7; wherein the thickness of the barrier layer is less than 10 μm and the thickness of each of the ceramics layers is not less than 10μm.

9. The liquid jetting apparatus according to claim 8; wherein the thickness of the barrier layer is not more than 1 μm.

10. The liquid jetting apparatus according to claim 1; wherein the barrier layer is an insulative layer.

11. The liquid jetting apparatus according to claim 1; wherein the barrier layer is formed of a material which is different from a material forming the ceramics layers.

12. The liquid jetting apparatus according to claim 1; wherein the barrier layer is interposed between two ceramics layers of the ceramics layers stacked in the stacking direction.

* * * * *